United States Patent [19]

Topel

[11] 4,116,194

[45] Sep. 26, 1978

[54] PEEP SIGHT FOR ARCHERY BOW

[75] Inventor: Kenneth D. Topel, Puyallup, Wash.

[73] Assignee: Fine-Line, Inc., Puyallup, Wash.

[21] Appl. No.: 733,229

[22] Filed: Oct. 18, 1976

[51] Int. Cl.[2] ..... F41B 5/00

[52] U.S. Cl. ..... 124/87; 33/265

[58] Field of Search ..... 124/87, 90, 23 R, 24 R; 33/265; 128/DIG. 15

[56] References Cited

U.S. PATENT DOCUMENTS

| | | | |
|---|---|---|---|
| 1,885,962 | 11/1932 | Swenson et al. | 124/23 R |
| 2,574,599 | 11/1951 | Stieber | 124/87 X |
| 3,258,000 | 6/1966 | Kolpacki | 124/90 X |
| 3,297,026 | 1/1967 | Van Pelt | 128/DIG. 15 X |
| 3,410,644 | 11/1968 | McLendon | 124/24 R X |
| 3,665,911 | 5/1972 | Altier | 124/24 R |
| 3,866,592 | 2/1975 | Carella | 124/24 R |

*Primary Examiner*—William R. Browne

*Attorney, Agent, or Firm*—Christensen, O'Connor, Johnson & Kindness

[57] ABSTRACT

A peep sight having a body with a sighting bore therethrough. The body receives a bow string and is connected by an elastic cord to the bow. When the bow string is in a drawn position the sight bore in the body of the peep sight is substantially horizontal. When the bow string is in a relaxed condition the bore is in an angled position with the longitudinal extension of the bow string. An elastic cord, such as a piece of flexible tubing, has one end fitted onto a pin extending from the body of the peep sight and a second end fitted onto a block which itself is adapted to be secured to an archery bow. As the bow string is drawn upon mounting of the body on the bow string and securing of the block to the archery bow, the elastic cord stretches to exert a force upon the body to align a sighting bore or "peep" therethrough with a bow-mounted bow sight.

11 Claims, 5 Drawing Figures

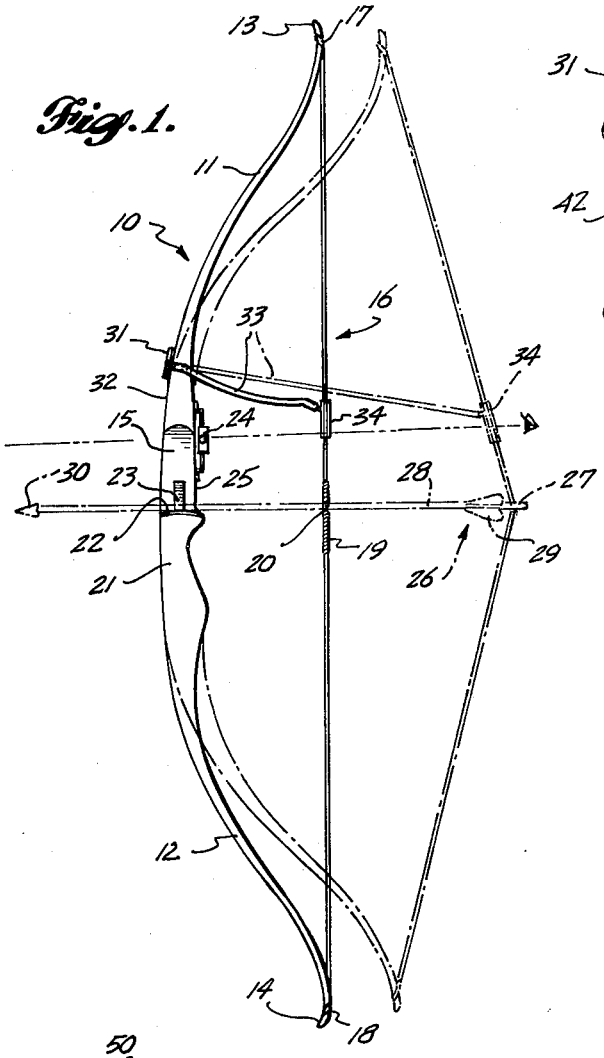
Fig. 1.
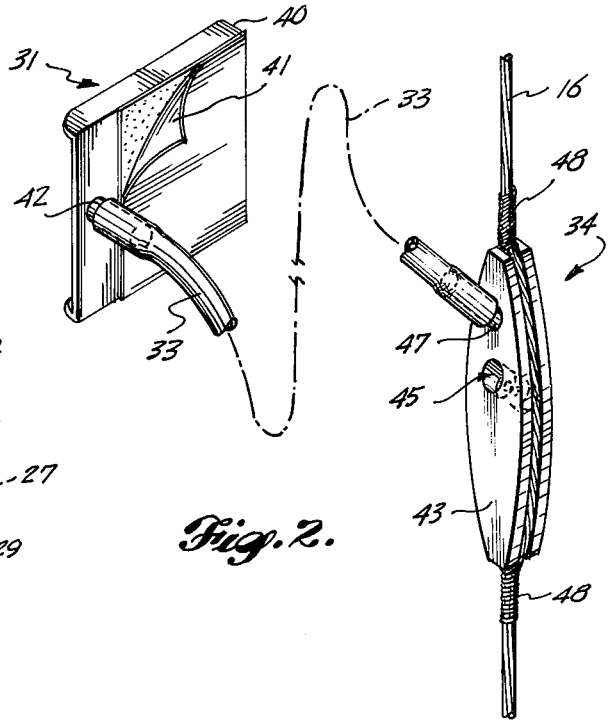
Fig. 2.
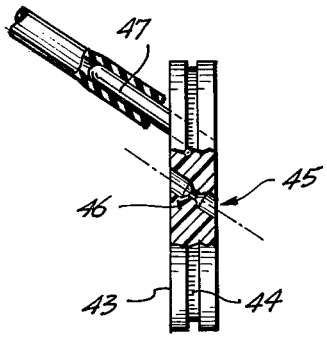
Fig. 3.
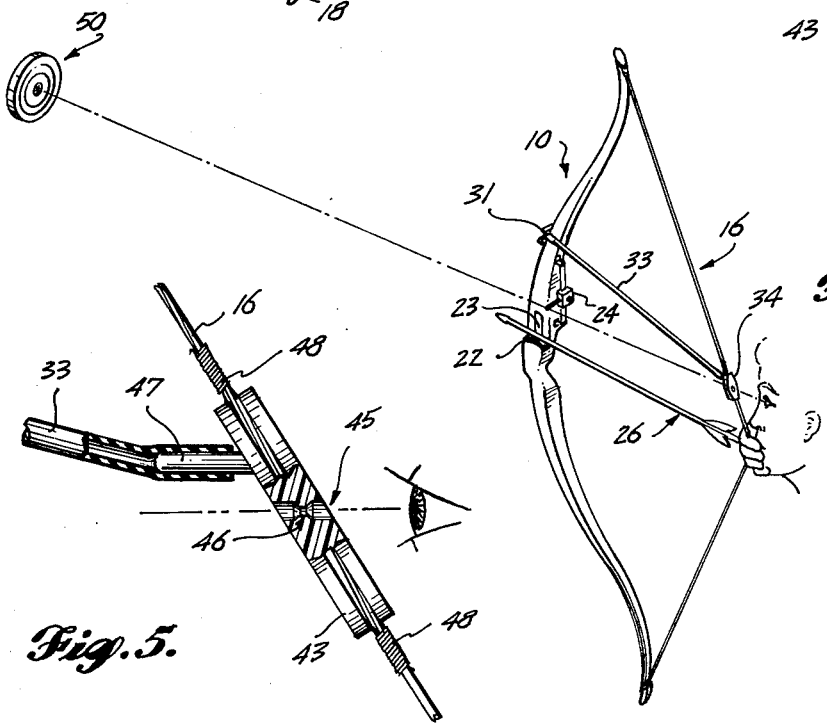
Fig. 4.
Fig. 5.

PEEP SIGHT FOR ARCHERY BOW

FIELD OF THE INVENTION

This invention generally relates to sighting apparatus for archery, and, more particularly, to a peep sight forming part of such sighting apparatus.

BACKGROUND OF THE INVENTION

The equipment now available to modern archers has resulted in tremendous increases in both the accuracy and precision with which an archer can consistently hit a distant target. Improved sighting apparatus is responsible for much of this increased accuracy and precision, with the sighting apparatus including both bow-mounted bow sights and string-mounted peep sights. Typically, a bow sight includes a number of pins or other means which are projected into the archer's field of vision, with the pins being vertically spaced from each other to correspond to different ranges between the archer and the target. If the archer places his arrow at a defined point on the bow string (called the nocking point), draws the bow string back a predetermined amount, and places his aiming eye at a predetermined distance above the nocking point, then alignment of the pin in the bow sight corresponding to the estimated range with the target should result in the arrow being released from the bow with the proper trajectory to hit the target.

Oftentimes, however, the archer will not pull the bow string back a predetermined amount, nor will he maintain his aiming eye at a predetermined distance above the nocking point. Accordingly, a peep sight is mounted on the bow string at a point above the nocking point corresponding to the predetermined distance between the archer's aiming eye and the nocking point. Extending through the peep sight at an angle with respect to the longitudinal dimension of the bow string is a very small bore which is aligned with the bow sight pin in the desired direction of travel of the arrow only when the bow string has been pulled back the desired predetermined amount.

In practice, peep sights are very difficult to use inasmuch as the bow string, being typically formed from a plurality of twisted strands, tends to rotate ever so slightly when drawn so that it is difficult to align the bore with the bow sight pin. It has, therefore, been found necessary to increase the diameter of the bore to compensate for the slight twisting of the bow string, thereby resulting in an accuracy and precision in shooting which is less than that theoretically obtainable.

It is therefore an object of this invention to provide an improved peep sight for archery.

It is a further object of this invention to provide such an improved peep sight in which the bore therethrough can easily be aligned with the bow sight pin despite the tendency of the bow string to twist upon being drawn.

It is still a further object of this invention to provide such an improved peep sight in which the diameter of the bore can be maintained at a small value necessary for accurate and precise shooting.

SUMMARY OF THE INVENTION

Briefly, these and other objects which will be apparent to those skilled in the art are achieved by an improved peep sight for an archery bow, the peep sight comprising a body configured to be mounted on a bow string, the body having a bore extending therethrough, and, an elastic cord having first and second ends, the first end of the elastic cord being secured to the body and the second end of the elastic cord being adapted to be secured to an archery bow, the elastic cord having a length such that the elastic cord is capable of being stretched when its second end is secured to an archery bow, the body is mounted on a bow string, and the bow string is drawn.

BRIEF DESCRIPTION OF THE DRAWINGS

The invention can perhaps best be understood by reference to the following portion of the specification, taken in conjunction with the accompanying drawings in which:

FIG. 1 is a side elevation view showing a typical bow, bow string and arrow and the improved peep sight of the present invention;

FIG. 2 is a pictorial view showing details of the improved peep sight;

FIG. 3 is a side elevation view of a string-mounted portion of the improved peep sight, with a portion cut away to illustrate the bore therethrough;

FIG. 4 is a pictorial view illustrating how the bow, bow string and the improved peep sight of FIG. 1 are used to aim an arrow at a target; and FIG. 5 is a side elevational and partial cross-sectional view of a portion of the improved peep sight as mounted in a drawn bow string.

DESCRIPTION OF THE PREFERRED EMBODIMENT

Referring now to FIG. 1, an archery bow 10, of a conventional recurve construction, includes a handle 15 with integral, upper and lower limbs 11, 12 which terminate, respectively, in bow tips 13, 14. A bow string 16, which may be conventionally made from a plurality of twisted strands of thread, is strung between the upper and lower bow tips 13, 14 and in particular has a first end loop received within a string notch 17 in upper bow tip 13 and a second end loop received within a string notch 18 in lower bow tip 14. A serving 19, which may comprise a rubber sleeve fitted over the bow string 16, or, a thread wrapped around bow string 16, is located on the bow string 16 in the vicinity of a nocking point thereof, or, the point at which an arrow is to be attached to the bow string 16. A nock locator 20, which may comprise a compressible sleeve fitted over the serving 19, precisely determines the nocking point.

A hand grip 21 is provided on the handle 15, with an arrow rest 22 being located immediately above the grip 21. Typically, the arrow rest 22 may comprise a ledge formed in the handle 15, with an arrow plate 23 being provided on the handle 15 adjacent to the arrow rest 22 to deaden sound that the arrow creates as it passes by the handle 15 after being released. It is also known for the arrow rest 22 and arrow plate 23 to be combined into an integral member attached to the side of the handle 15. A bow sight 24 is located on a belly, or inner, surface 25 of the handle 15 at a predetermined location above the arrow rest 22. As best seen in FIG. 4, the bow sight 24 includes a pin which projects into the archer's line of sight to the left of the bow 10 (as viewed from the rear), with the pin being vertically adjustable to indicate different ranges between the archer and a desired target. The bow sight 24 may also include, as previously discussed, a plurality of pins, each of which projects into the archer's line of sight, and which are vertically spaced from each other to preset the desired ranges.

To use the apparatus thus described, the archer places a nock 27 of an arrow 26 into engagement with the serving 19 of the bow string 16 just above or just below the nock locator 20. Typically, the nock 27 comprises a member which fits onto a first end of a shaft 28 of the arrow 26, with the member including a pair of tines defining therebetween an open notch within which the serving 19 is received. As illustrated, fletching or feathers 29 are provided adjacent the nock 27, and the second end of the shaft 28 terminates in an arrowhead 30. With the shaft 28 being supported by the arrow rest 22, the bow string 16 is then drawn back by the archer a predetermined amount as indicated by the dashed-line portion of FIG. 1. Typically, the archer will try to maintain the nocking point, as represented by the nock locator 20, at a predetermined location on his face so that his aiming eye is a predetermined distance above the nocking point. The archer then aligns the projected pin of the bow sight 24 with a desired point on the target, such as target 50 in FIG. 4. Previously, the archer will have experimented with the vertical location of the projected pin to set that location for the estimated range between the archer and the target 50. When the projected pin of bow sight 24 is thus aligned with the desired point on target 50, release of the bow string 16 by the archer should result in the arrow 26 being ejected with a trajectory that will carry the arrowhead 30 to the desired target point.

In practice, however, it has been found that the archer will not consistently maintain his aiming eye at a predetermined distance above the nocking point, nor will he consistently draw the bow string 16 back a predetermined amount. Therefore, the accuracy and precision with which the archer can hit the desired point on the target 50 is limited. To increase this accuracy and precision, the archer typically uses a peep sight (such as peep sight 34) mounted on the bow string 16 to define the predetermined distance between the archer's aiming eye and the nocking point and the predetermined amount of bow string draw. In FIGS. 2, 3, and 5, the peep sight 34 includes a body 43, typically formed by injection-molding a lightweight plastic material, such as ABS plastic, which has planar front and back surfaces 43A, 43B, and a pair of arcuate side surfaces 43C. A groove 44 is located on each side surface 43C and extends substantially parallel to front and back surfaces 43A, 43B. The body 43 is mounted on the bow string 16 by separating the strands thereof into first and second groups and inserting the body 43 within the bow string 16 with the first and second groups of strands being received within the respective grooves 44. The body 43 is maintained at a predetermined position on the bow string 16 by string wrapped around the bow string 16 immediately above and below the body 43, as indicated by the reference numerals 48. A bore 45 extends through the body 43 between surfaces 43A and 43B at an angle with respect to a normal drawn to surfaces 43A and 43B and thus is angled with respect to the longitudinal dimension of bow string 16 when the body 43 is mounted therein, as best illustrated in FIG. 5. The bore 45 has a necked-down portion 46 therein which defines a very small aperture or "peep" for sighting. If the body 43 were to be viewed from top, it would be noted that the bore 45 extends through body 43 at right angles to surfaces 43A and 43B.

In operation, the archer places the arrow 26 on the bow string 16, with the shaft 28 thereof being supported on the arrow rest 22, and draws back the bow string 16 as previously described. Those skilled in the art will appreciate that securement of the peep sight 34 at a predetermined location with respect to the nocking point (determined by the nock locator 20) will assure that the archer's aiming eye is always located at the same predetermined distance above the nocking point. Further, since the bore 45 is angled with respect to the bow string 16, it will be appreciated that the very small aperture therein defined by the necked-down portion 46 will be aligned with the projected pin of the bow sight 24 only when the bow string 16 has been pulled back a predetermined amount. In practice, however, the peep sight, such as peep sight 34, is very difficult to use inasmuch as the twisted strands in the bow string 16 tend to cause the body 43 to rotate about an axis aligned with the longitudinal dimension of bow string 16 as the bow string 16 is pulled back. The bore 45 is accordingly oftentimes out of alignment with the projected pin of bow sight 24, being slightly to the left or slightly to the right thereof. As a result, the projected pin of the bow sight 24 often cannot be seen by the archer even through the bow string 16 has been pulled back the predetermined amount at which the projected pin should come into view.

The present invention therefore contemplates a block 40, preferably formed from a plastic material such as ABS plastic by injection-molding, which has adhesive material 41 located on a first, substantially planar surface 41A thereof for securing the block 40 to a back, or outer surface 32 on the handle 15. As shown in FIG. 2, the adhesive material 41 may comprise a flexible adhesive strip with a peel-away paper backing. A pin 42 projects from the block 40 and has fitted thereon one end of an elastic cord 33 whose other end is fitted over a pin 47 projecting from the front surface 43A of body 43 of peep sight 34. The pins 42 and 47 may be molded integrally with block 40 and body 43, respectively, or, they may comprise separate pins press-fitted into corresponding apertures through block 40 and body 43.

The angles at which the pins 42 and 47 respectively project from the block 40 and body 43 are not critical, it being preferred, however, that the pin 42 project at right angles from the block 40 and that a longitudinal axis of the pin 47 be substantially parallel to a longitudinal axis of bore 45 through body 43. Preferably, the block 40 is mounted on handle 15 so that the pin 42 projects to the left of handle 15 and is substantially aligned in a vertical direction with the projected pin of bow sight 24.

The length of the elastic cord 33 is chosen so that the cord 33 is slack when the bow string 16 is in its undrawn, rest position as illustrated in the solid line portions of FIG. 1. When the bow string 16 is drawn back, however, the elastic cord 33 is stretched so that the pin 47, and therefore the bore 45 in body 43, is directed toward the pin 42 which is located, as previously described, on the left side of the handle 15 in approximate vertical alignment with the projected pin of bow sight 24. Alternatively, it will be recognized by those skilled in the art that the location of the attachments of the elastic cord 33 to the handle 15, and to the body 43, may be varied so long as a force is exerted upon the body 43 upon drawing of the bow string 16 to align the bore 45 with the projected pin of the bow sight 24. As an example, the pin 42 may be located, when the mount 31 is placed on the back surface 32 of the handle 15, so that the pin 42 projects to the right side of the handle 15, with the pin 47 being angled to the right of a normal drawn to surface 43A when the body 43 is viewed from the top thereof.

It will also be recognized that the elastic cord 33 should exert upon the body 43 only that force needed to keep the body 43 from rotating, so as to not substantially affect the force with which the bow string 16 ejects the arrow 26 when released. In practice, a small piece of surgical tubing was found to work well as the elastic cord 33. A flat rubber ribbon, a thin metallic spring, or like material may also be used as the elastic cord 33.

While the invention has been described with respect to the preferred embodiment, it is to be clearly understood by those skilled in the art that the invention is not limited thereto, but rather is intended to be interpreted only in accordance with the following claims.

What is claimed is:

1. An improved peep sight comprising: a body having a sighting bore means extending therethrough, said body including means for mounting said body on a bow string so that said bore means is substantially horizontal when a bow string is in a drawn position and is angled with respect to a longitudinal extension of a bow string when a bow string is in a relaxed or uncocked position; and, an elastic cord means for attaching said body to a bow, said elastic cord means having first and second end means, said first end means being secured to said body and said second end means being adapted to be secured to an archery bow.

2. An improved peep sight as recited in claim 1, further comprising means for securing said second end means of said elastic cord means to an archery bow.

3. An improved peep sight as recited in claim 2, wherein said means for securing said second end means of said elastic cord means to an archery bow comprises a block having a first surface, and adhesive material located on said first surface for securing said block to an archery bow.

4. An improved peep sight as recited in claim 3, wherein said elastic cord means comprises a piece of flexible tubing having said first and second end means, wherein said block includes a first pin projecting from said first surface over which said second end means of said flexible tubing is fitted, and wherein said body includes a second pin projecting from said body over which said first end means of said flexible tubing is fitted.

5. An improved peep sight as recited in claim 4, wherein said first surface of said block is substantially planar, and wherein said first pin extends from said first surface at right angles thereto.

6. An improved peep sight as recited in claim 4, wherein said second pin has a longitudinal axis which is substantially parallel to a longitudinal axis of said bore means.

7. An improved peep sight as recited in claim 2, wherein said elastic cord means comprises a piece of flexible tubing.

8. An improved peep sight as recited in claim 1, wherein said body has substantially planar front and back surfaces which are parallel to each other, said bore means extending through said body from said first surface to said back surface at an angle with respect to a normal drawn thereto, said body also having a pair of arcuate side surfaces, and wherein said means for mounting said body comprises a groove located in each of said arcuate side surfaces and extending parallel to said front and said back surfaces.

9. An improved peep sight as recited in claim 8, wherein said elastic cord means comprises a piece of flexible tubing having said first and second end means, wherein said body includes a pin projecting from said front surface of said body over which said first end means of said flexible tubing is fitted, said pin having a longitudinal axis which is substantially parallel to a longitudinal axis of said bore means, and further comprising means for securing said second end means of said flexible tubing to an archery bow.

10. An improved peep sight as recited in claim 8, wherein said bore means also extends through said body at right angles with respect to said front and back surface thereof when viewed from the top of said body.

11. An improved peep sight as recited in claim 10, wherein said elastic cord means comprises a piece of flexible tubing having said first and second end means, wherein said body includes a pin projecting from said front surface of said body over which said first end means of said flexible tubing is fitted, said pin having a longitudinal axis which is substantially parallel to a longitudinal axis of said bore means, and further comprising means for securing said second end means of said flexible tubing to an archery bow.

* * * * *